US010144536B2

(12) United States Patent
Katsuyama et al.

(10) Patent No.: US 10,144,536 B2
(45) Date of Patent: Dec. 4, 2018

(54) VIBRATION DEVICE

(71) Applicant: GENERAL PACKER CO., LTD., Aichi (JP)

(72) Inventors: Kei Katsuyama, Aichi (JP); Naoyuki Kuniyoshi, Aichi (JP); Yuki Miyabe, Aichi (JP)

(73) Assignee: GENERAL PACKER CO., LTD., Aichi (JP)

( * ) Notice: Subject to any disclaimer, the term of this patent is extended or adjusted under 35 U.S.C. 154(b) by 45 days.

(21) Appl. No.: 15/364,580

(22) Filed: Nov. 30, 2016

(65) Prior Publication Data

US 2018/0148199 A1 May 31, 2018

(51) Int. Cl.
*B65B 1/22* (2006.01)
*B65B 5/06* (2006.01)

(52) U.S. Cl.
CPC ..... *B65B 1/22* (2013.01); *B65B 5/067* (2013.01)

(58) Field of Classification Search
CPC ..... B65B 1/22; B65B 5/067
USPC ..... 141/74, 75, 80
See application file for complete search history.

(56) References Cited

U.S. PATENT DOCUMENTS 2,767,743 A * 10/1956 Kindseth ..... B65B 39/08 141/195
5,113,918 A * 5/1992 McGregor ..... B65B 37/00 141/100
2002/0180399 A1* 12/2002 Bilcke ..... H02P 5/00 318/701
2009/0249890 A1* 10/2009 Kirst ..... B67C 3/20 73/861.354
2014/0331619 A1* 11/2014 Takahashi ..... B65B 1/22 53/525

FOREIGN PATENT DOCUMENTS

JP 1-100701 U 7/1989
JP 2000-109003 A 4/2000

OTHER PUBLICATIONS

Notification of Reasons for Refusal from Japanese Patent App. No. 2014-126081 (dated Dec. 8, 2017) with English language translation thereof.

* cited by examiner

*Primary Examiner* — Jason K Niesz
*Assistant Examiner* — James Hakomaki
(74) *Attorney, Agent, or Firm* — Cermak Nakajima & McGowan LLP; Tomoko Nakajima

(57) ABSTRACT

A vibrating device is incorporated in a packaging machine to vibrate packaging bags filled with articles. The vibrating device includes a tapping plate disposed below the bags, a servomotor having an output shaft, a selection unit selecting one of vibration patterns set according to sizes of the bags or types of the articles, an output unit delivering data of a rotation pattern of the output shaft, and a control unit controlling the output shaft according to the rotation pattern based on the delivered rotation data. When one vibration pattern is selected according to the size of the bag or the type of the articles, the control unit controls the output shaft according to the rotation pattern corresponding to the vibration pattern, so that the tapping plate connected via a link mechanism to the output shaft is vibrated up and down in the selected vibration pattern to vibrate the bag.

2 Claims, 5 Drawing Sheets

VIBRATION DEVICE

BACKGROUND

1. Technical Field

The present disclosure relates to a vibrating device which is incorporated in a packaging machine filling a packaging bag with articles and which applies vibration to the packaging bag filled with the articles.

2. Related Art

A rotary type packaging machine has conventionally been known which fills packaging bags with articles comprising grain, pelleted dog food or like powder and granular material. The rotary type packaging machine includes a plurality of devices which are in charge of respective steps of feeding packaging bags, opening the packaging bags, filling the packaging bags with articles, shaping the packaging bags and sealing the packaging bags. These devices are disposed around a rotary. A vibrating device applying vibration to the packaging bags filled with the articles is used in the shaping step. Gaps among the articles in the packaging bag are closed as the result of application of vibration to the packaging bags, whereby a filling density can be improved and a cubic capacity of the articles can be reduced. Thus, the packaging bags can be shaped in such a manner that the packaging bags can be stacked flat.

FIG. 5 illustrates a conventional vibrating device 100. The vibrating device 100 includes a base unit 101 having a vibration unit with a general-purpose motor (not illustrated). A support pillar 102 stands on the base unit 101. A holder panel 103 is mounted on the support pillar 102. The holder panel 103 is formed with an elongate slide hole 104 which is parallel to the support pillar 102. A tapping plate 106 is placed in the slide hole 104 with a plate holder 105 being interposed therebetween. The tapping plate 106 is configured to apply vibration to the packaging bag filled with the articles.

In the vibrating device 100, the stroke of the tapping plate 106 is adjusted by changing the general-purpose motor of the base unit 101 to another or by changing a cam converting rotation of the motor to up-down movement to another. A vibration period is adjusted by changing a rotating speed of an output shaft of the motor. Furthermore, a level of the tapping plate 106 is adjusted by moving the plate holder 105 in the up-down direction along the slide hole 104 according to a size of the packaging bag. The plate holder 105 is fixed in the slide hole 104 by a clamp lever 107. When the clamp lever 107 is loosened, the plate holder 105 is movable in the up-down direction along the slide hole 104.

Furthermore, Japanese Patent Application Publication No. JP-A-2001-315705 discloses a filling device which fills a filling bag with powder or granular material. The filling device includes a tapping unit configured to be moved in the up-down direction by a tapping motor and to tap the filling bag at predetermined intervals.

Japanese Patent Application Publication No. JP-A-S51-19690 discloses an automatic tea-leaf measuring and packaging machine including a tapping device. The tapping device is configured to transmit rotative movement of an electric motor via an eccentric cam and a rod to a tapping plate in contact with a packaging bag. The motor is rotatively moved at predetermined intervals.

In the above-described vibrating devices, the rotative movement of the general-purpose motor is converted to the up-down movement by the cam, and the tapping plate is vibrated directly or indirectly by the use of the rod or the like. Accordingly, it is difficult to change the amplitude of the tapping plate after the rotary type packaging machine has once been installed at a predetermined location. Furthermore, the level of the tapping plate is adjusted by positioning the tapping plate by manually up-down moving a slide holder along the slide hole according to the size of the packaging bag or adjusting with a jack or moving the tapping plate together with the packaging machine along the support pillar. The level adjustment of the tapping plate is troublesome every time the packaging bag is changed from one type to another.

SUMMARY

Therefore, an object of the present disclosure is to provide a vibrating device which can freely adjust the amplitude, the period of the tapping plate moved in the up-down direction, or the like and can move the tapping plate freely to an optimum location with respect to the packaging bag.

The present disclosure provides a vibrating device incorporated in a packaging machine which fills packaging bags with articles and vibrating the packaging bags filled with the articles. The vibrating device includes a tapping plate, a servomotor, a link mechanism, a selection unit, an output unit, and a control unit. The tapping plate is formed into a generally flat shape and disposed below the packaging bags. The servomotor has an output shaft rotatable forward and backward. The link mechanism connects the servomotor and the tapping plate to each other and converts rotation of the output shaft into an up-and-down motion of the tapping plate. The selection unit selects one of a plurality of vibration patterns set according to sizes of the packaging bags or types of the articles and relating to the up-and-down motion of the tapping plate. The output unit delivers rotation data relating to a rotation pattern of the output shaft. The rotation pattern is set so as to correspond to the selected vibration pattern. The control unit controls rotation of the output shaft according to the rotation pattern based on the delivered rotation data. When one of the vibration patterns is selected according to the size of the packaging bag or the type of the articles, the control unit controls rotation of the output shaft according to the rotation pattern corresponding to the vibration pattern, so that the tapping plate connected via the link mechanism to the output shaft is vibrated up and down in the selected vibration pattern thereby to vibrate the packaging bag.

In the above-described vibrating device, a plurality of vibration patterns is set, each of which patterns includes data according to the size of the packaging bag and the type of the articles. For example, the data includes a vibration start position of the tapping plate vibrated up and down, amplitude of the vibrated tapping plate, and frequency of the tapping plate per unit time. Furthermore, a plurality of rotation patterns corresponding to the respective vibration patterns may be formed. Each rotation pattern may include a rotation start angle corresponding to the vibration start position, a rotation angle range of the output shaft corresponding to the amplitude, and a rotating speed of the output shaft corresponding to the frequency. When one of the vibration patterns is selected, the output shaft of the servomotor is controlled according to rotation data of the rotation pattern corresponding to the selected vibration pattern. As a result, the vibrating device can dispose the tapping plate at the vibration start position according to the size of the packaging bag and the type of the articles. Furthermore, the above-described vibrating device can vibrate the tapping plate in a predetermined vibration pattern according to the size of the packaging bag and the type of the articles.

Furthermore, the above-described vibrating device is constructed by connecting the tapping plate and the servomotor to each other by the link mechanism in a simple manner. Accordingly, the above-described vibrating device can reduce the number of parts and components and the number of manufacturing steps as compared with conventional vibrating devices with the result of reduction in cost-per-use.

Furthermore, the above-described vibrating device has a simple structure as described above and another simple structure that the vibration of the tapping plate is controllable by control of the output shaft. Accordingly, adjustment according to the packaging bag and maintenance can be carried out more easily in the above-described vibrating device as compared with conventional vibrating devices, with the result of reduction in the working time and running costs.

DETAILED DESCRIPTION

Figure 1:
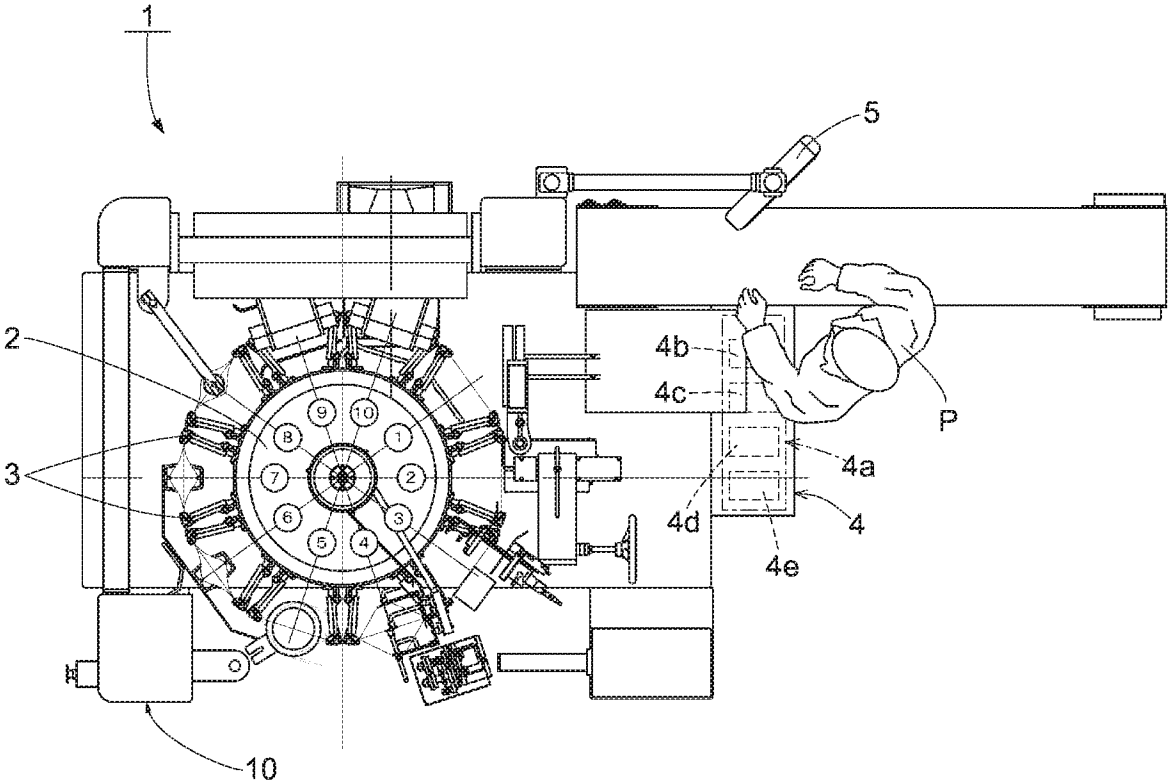
FIG. 1 is a schematic plan view of a packaging machine in which a vibrating device according to one embodiment is incorporated.

One embodiment will be described with reference to FIGS. 1 to 4 of the accompanying drawings. Referring to FIG. 1, an overall construction of a rotary type packaging machine 1 in which a vibrating device 10 according to the embodiment is incorporated is schematically illustrated. The rotary type packaging machine 1 includes a rotary 2 rotated at a predetermined rotating speed. A plurality of grips 3 which holds a packaging bag is mounted on the rotary 2. The packaging machine 1 is configured to sequentially carry out:

a first step of holding a packaging bag by the grips 3 (a bag feeding step);

a second step of opening a chuck of the packaging bag (a chuck opening step) and printing on the packaging bag signs or bar codes indicative of manufacturing date and manufacturing plant or identification marks similar to the signs or bar codes (a printing step);

a third step of checking and certifying the printed identification marks (a checking/certifying step);

a fourth step of opening the packaging bag (an opening step);

a fifth step of filling the packaging bag with articles (a filling step);

the fifth to seventh steps of applying vibration to the bottom of the packaging bag (a vibrating step);

an eighth step of pushing the articles into the bag (a pushing step) and of blowing off the articles adherent to the opening of the packaging bag (a blowing step);

a ninth step of sealing the opening (a top sealing step) while deflating the packaging bag (a deflating step); and a tenth step of cooling the vicinity of the sealed opening (a cooling step) and detaching the packaging bag from the grips and discharging the packaging bag (a product discharging step).

The packaging machine 1 carries out the above-mentioned steps while the grips 3 are moved along the circumference of the rotary 2 substantially one turn. As a result, the packaging machine 1 can fill the packaging bags with the articles with the space being conserved. Furthermore, the packaging machine 1 can shorten the traffic line of a worker since the first or bag feeding step is adjacent to the tenth or product discharging step, with the result that the working efficiency can be improved.

A plurality of devices is incorporated in the above-mentioned steps of the packaging machine 1 to have charge of the respective steps. The vibrating device 10 according to the embodiment has charge of the fifth to seventh steps or the vibrating step.

Figure 2:
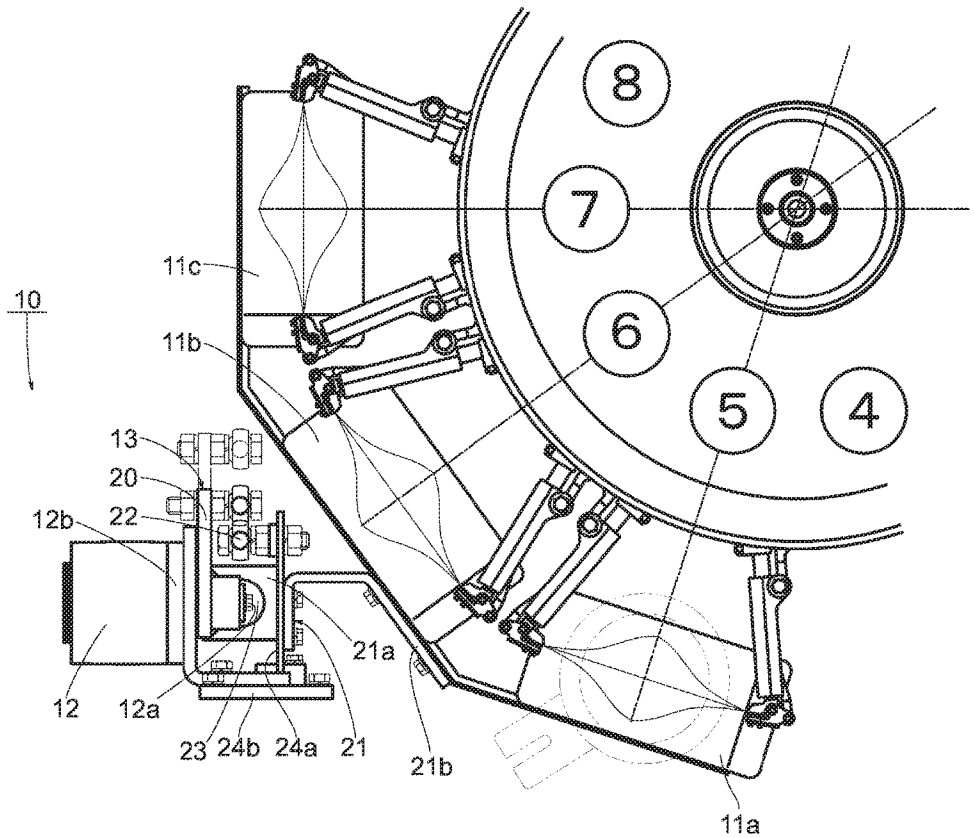
FIG. 2 is a schematic plan view of the vibrating device.
Figure 3:
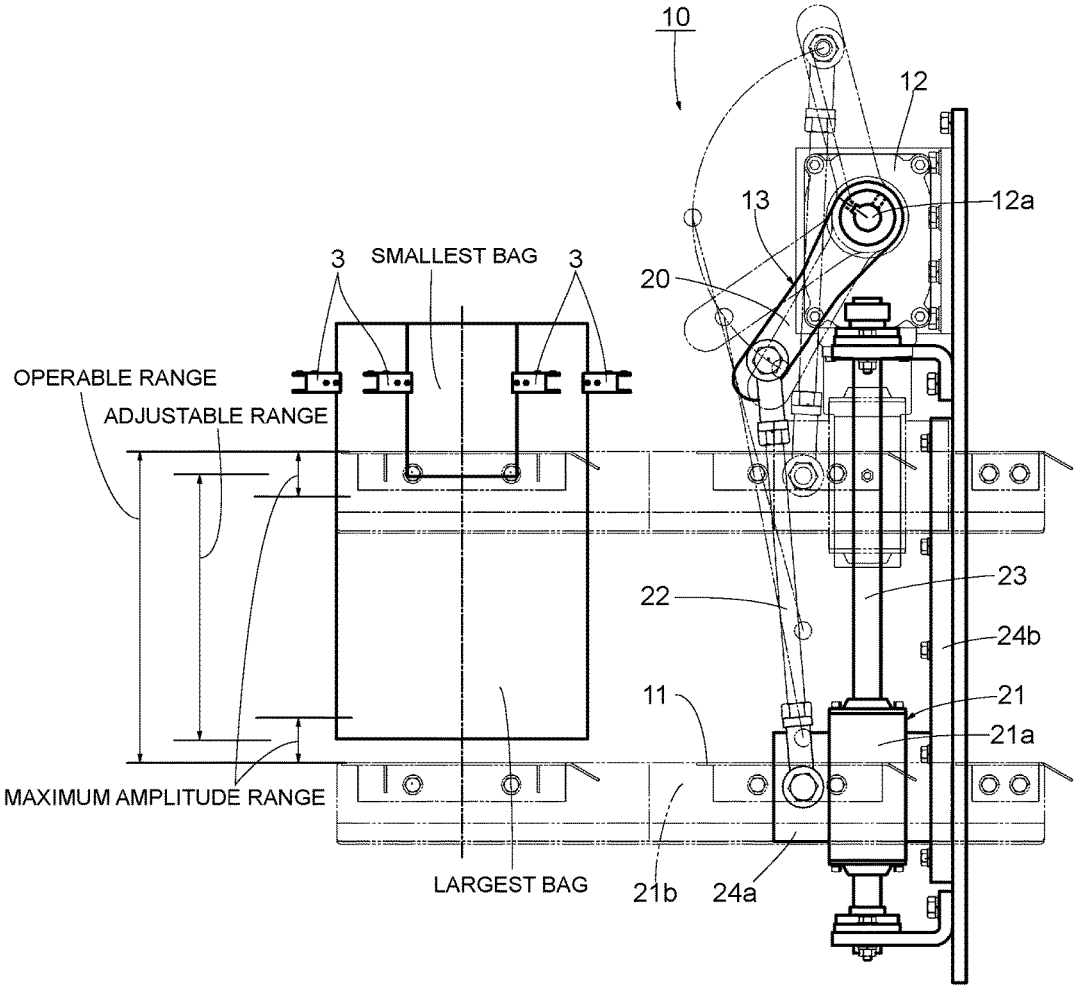
FIG. 3 is a schematic side elevation of the vibrating device.

The vibrating device 10 includes a tapping plate 11, a servomotor 12, a link mechanism 13 connecting the tapping plate 11 and the servomotor 12 to each other, and a control section (not illustrated) having a control unit which controls an operation of the servomotor 12, as illustrated in FIGS. 2 and 3. The tapping plate 11 is formed into a flat shape and includes a tapping portion applying vibration to the bottom of the packaging bag and a mounting portion attached to the link mechanism 13. The tapping portion includes a first tapping portion 11*a* tapping the bottom of the packaging bag at the fifth step, a second tapping portion 11*b* tapping the bottom of the packaging bag at the sixth step and a third tapping portion 11*c* tapping the bottom of the packaging bag.

In the embodiment, the first to third tapping portions 11*a* to 11*c* are adjusted so that upper sides of the first to third tapping portions 11*a* to 11*c* become coplanar. However, the tapping portions 11*a* to 11*c* should be limited to this adjusting manner. The first to third tapping portions 11*a* to 11*c* may be adjusted so that levels of the upper sides of the tapping portions 11*a* to 11*c* are gradually reduced or increased thereby to be formed in a stepwise pattern. When the upper sides of the tapping portions 11*a* to 11*c* are coplanar, vibration can be applied to the packaging bag by a constant force. When the upper sides of the tapping portions 11*a* to 11*c* are arranged in the stepwise pattern, the intensity of vibration applied to the packaging bag can be adjustable.

The servomotor 12 has an output shaft 12*a* and a reducer 12*b*. The reducer 12*b* comprises at least a first gear brought into mesh engagement with the rotating shaft 12*c* of the servomotor 12 and a final gear brought into mesh engagement with the output shaft 12*a*. The servomotor 12 can rotate the output shaft 12*a* by reducing rotating speeds of the rotating shaft 12*c* at a predetermined reduction ratio. The servomotor 12 can thus deliver power of the rotating shaft 12*c* from the output shaft 12*a*.

The link mechanism 13 comprises drive lever 20, a slide holder 21 and a connecting rod 22 which connects the drive lever 20 and the slide holder 21 to each other. The link mechanism 13 is configured to convert forward or reverse rotation delivered from the output shaft 12*a* into corresponding up-down movement of the tapping plate 11. The drive lever 20 has a proximal end fixed to the output shaft 12*a* of the servomotor 12 and a distal end connected to a proximal end of the connecting rod 22. As a result, the distal end of the drive lever 20 can be rotated in the forward and reverse directions along an arc drawn about the proximal end of the drive lever 20 with the length L1 of the drive lever 20 serving as a radius.

The slide holder 21 includes a hollow body-like slide portion 21*a* and a holder portion 21*b* continuous to the slide portion 21*a*. The slide holder 21 is movable upward and downward along a slide shaft 23. The slide portion 21*a* has a hollow part into which the slide shaft 23 is inserted. As a result, the slide holder 21 is movable upward and downward along the slide shaft 23. The holder portion 21*b* includes a mounting plate to which mounting portions of the tapping plates 11 continuous to the respective tapping portions 11*a*, 11*b* and 11*c* are fixed by bolts, and a bracket supporting the mounting plate. As a result, the slide holder 21 can hold a plurality of tapping plates 11 according to shapes of the brackets.

The slide shaft 23 includes a cylindrical bar-like body and stands near the servomotor 12. A guide 24 is juxtaposed to the slide shaft 23 and smoothly moves the slide holder 21 upward and downward. The guide 24 includes a retainer plate 24*a* mounted on the slide portion 21*a* of the slide holder 21 and a guide plate 24*b* juxtaposed to the slide shaft 23. The retainer plate 24*a* has a side abutting against the guide plate 24*b*. As a result, the slide holder 21 can be prevented from rotation along the circumferential direction of the slide shaft 23, so that the slide holder 21 can smoothly be moved upward and downward along the slide shaft 23.

The connecting rod 22 has a proximal end rotatably connected to the distal end of the drive lever 20 and a distal end rotatably connected to the slide portion 21*a* of the slide holder 21, thereby being configured to connect the drive lever 20 and the slide holder 21 to each other.

In the link mechanism 13 having the above-described structure, when the drive lever 20 is rotated forward, the connecting rod 22 following the operation of the drive lever 20 raises the slide holder 21 upward along the slide shaft 23. On the other hand, when the drive lever 20 is rotated backward, the connecting rod 22 following the operation of the drive lever 20 pushes the slide holder 21 downward along the slide shaft 23. More specifically, the link mechanism 13 is configured to convert rotation of the drive lever 20 to up-and-down motion of the slide holder 21. Thus, the slide holder 21 vibrates the tapping plate 11 up and down, so that the vibrating device 10 can convert rotation of the output shaft 12*a* of the servomotor 12 to up-and-down motion of the tapping plate 11.

Furthermore, the rotary type packaging machine 1 has a control panel 4 disposed to be located by an operator P and an operation part 5 which is located so as to be opposed to the operator P and is movable. The control panel 4 has a control part further having a selection unit, an output unit and a control unit. The operation part 5 has an input unit including a monitor screen (not illustrated) with a touch panel. The operation part 5 may be provided with a keyboard, push buttons, a dial or like input device.

The control part has an external storage medium, which stores vibration data relating to a plurality of vibration patterns. Each vibration pattern includes vibration data inclusive of set parameters such as a vibration start position where the up-and-down motion of the tapping plate 11 is initiated, an amplitude in the case where the tapping plate 11 is vibrated and vibration frequency per unit time in the case where the tapping plate 11 is vibrated, according to data of a packaging bag and an article such as the size of the packaging bag, the type of the articles, and an amount of articles filling the packaging bag.

The selection unit is configured to select one of the plural vibration patterns according to the size of the packaging bag, the type of the articles and the like. One vibration pattern is selected via the input unit by the operator P. When one vibration pattern is selected by the selection unit, the vibration data relating to the one vibration pattern is delivered from the selection unit to the output unit.

The operator P selects one of the vibration patterns via the input unit in the embodiment as described above. However, for example, one of the vibration patterns may automatically be selected by judging the packaging bag and the articles to be used with the packaging machine 1 by detection of the size of the packaging bag and the type of the articles at the first step in which the packaging bags are fed in the rotary type packaging machine 1 or the fifth step in which the packaging bag is filled with the articles.

The output unit is configured to read from the external storage medium a rotation pattern corresponding to a vibration pattern based on the vibration data delivered from the selection unit. The rotation pattern has rotation data corresponding to the vibration data, and plural rotation patterns are formed so as to be paired with predetermined vibration patterns respectively.

The rotation data is generated by setting parameters so that these parameters correspond to the respective parameters of the vibration data. The parameters to be generated include those of a rotation start angle of the output shaft 12*a* corresponding to the vibration start angel of the tapping plate 11, a rotation angle range of the output shaft corresponding to the amplitude of the tapping plate 11 and a rotating speed of the output shaft 12*a* corresponding to the vibration frequency of the tapping plate 11.

The output unit 4*c* is configured to deliver to the control unit the rotation data relating to the rotation pattern read from the external storage medium. The control unit is configured to rotate the output shaft 12*a* of the servomotor 12 to the rotation start angle according to the rotation pattern delivered from the output unit and further to control the operation of the output shaft 12*a* which is rotated at a predetermined rotating speed, within a predetermined rotation angle range. As a result, the control unit can control the operation of the servomotor 12.

The vibrating device 10 of the embodiment is constructed as described above. The working of the vibrating device 10 will now be described with reference to the accompanying drawings. The tapping plate 11 is moved upward along the slide shaft 23 when the output shaft 12*a* of the servomotor 12 is rotated forward. The tapping plate 11 is moved downward along the slide shaft 23 when the output shaft 12*a* is rotated backward. More specifically, the tapping plate 11 is vibrated up and down when the output shaft 12*a* is rotated alternately forward and backward. The control unit controls an angle by which the output shaft 12*a* of the servomotor 12 is rotated and a rotating speed at which the output shaft 12*a* is rotated.

Figure 4:
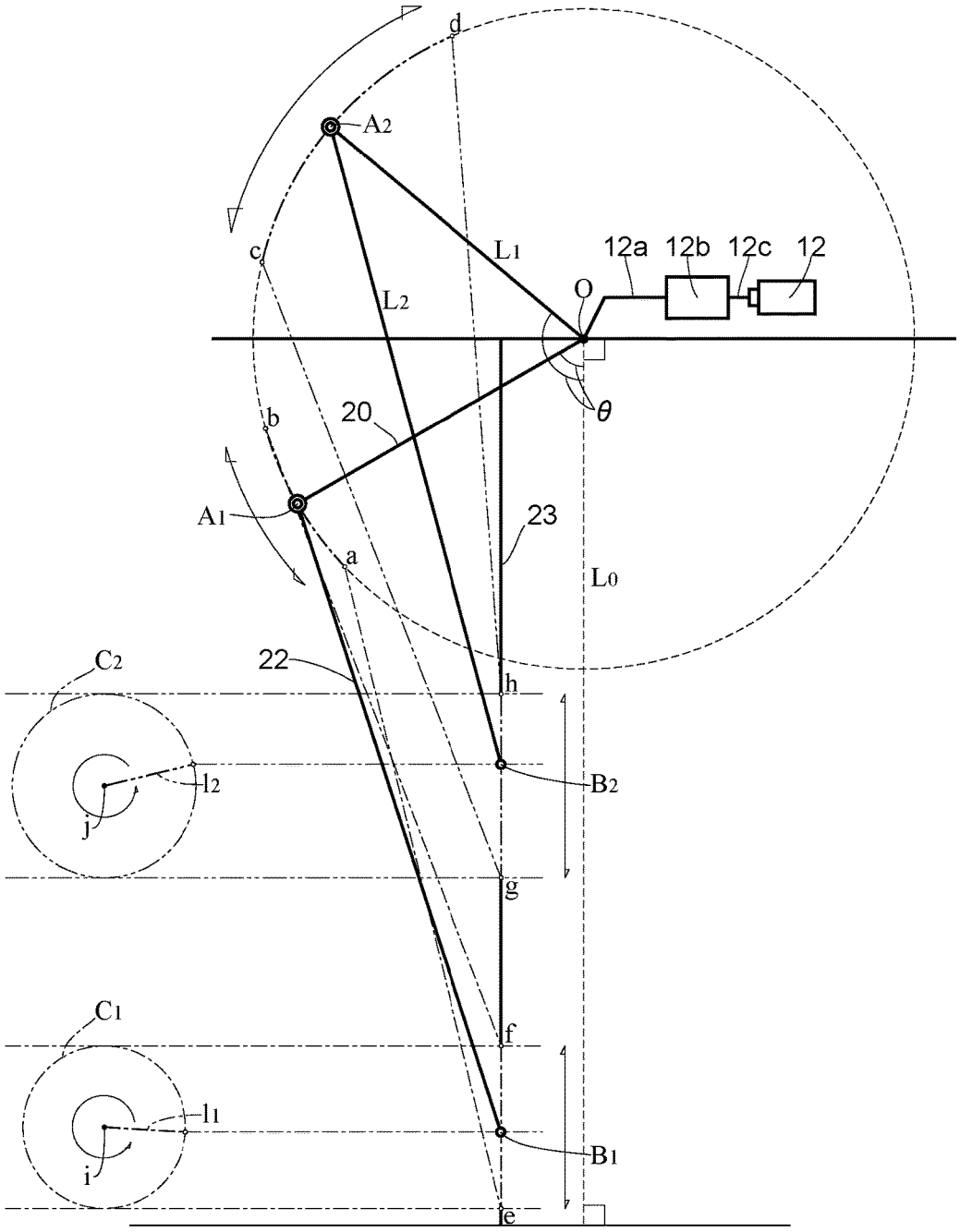
FIG. 4 is a schematic diagrammatic view of the vibrating device, explaining the working of the vibrating device.
Figure 5:
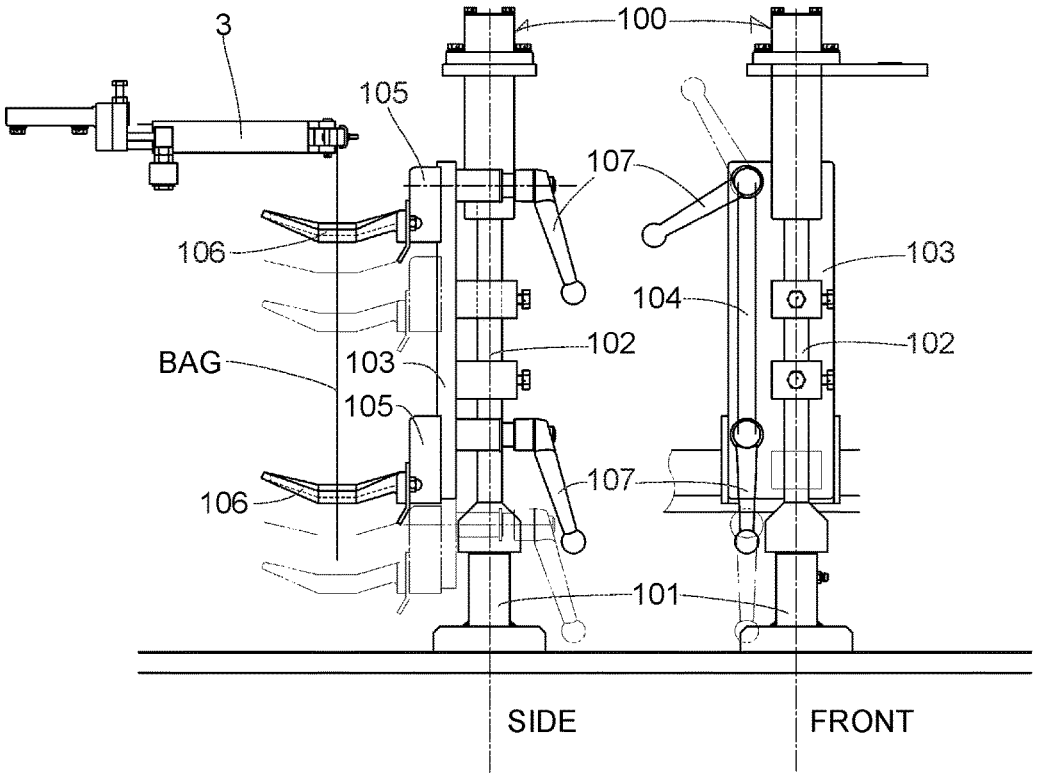
FIG.5 RELATED ART
FIG. 5 is a schematic side elevation of one of conventional vibrating devices.

The up-and-down motion of the tapping plate 11 will be described with reference to FIG. 4, in which the slide holder 21 is eliminated. The servomotor 12 is configured to deliver rotative power from the output shaft 12*a* via the reducer 12*b* as illustrated in FIG. 4. Reference symbol "O" designates a connection between the output shaft 12*a* and the drive lever 20. Reference symbol "$L_0$" designates an auxiliary line extending vertically downward from the connection O. Reference symbol "θ" designates an angle made between the auxiliary line $L_0$ and the drive lever 20. A change in the angle θ is controlled, namely, the operation of the servomotor 12 is controlled so that a change in the rotative angle of the output shaft 12*a* is controlled.

The drive lever 20 has a distal end which is rotated on a circumference of a circle having the connection O as the center and radius $L_1$. Assume now that point a is determined depending on one angle $\theta_a$ of the drive lever 20 and point b on the circumference is determined depending on another angle $\theta_b$. An arc ab sandwiched between points a and b and illustrate by a dot-and-dash line in FIG. 4 is a rotation angle range of the drive lever 20, which range is synchronized with the rotation angle range of the servomotor 12. Reference symbol "$A_1$" designates a connection between the drive lever 20 and the connecting rod 22. Furthermore, a two-dot chain line in FIG. 4 designates a rotation angle range of the drive lever 20 of an arc cd. Reference symbol "$A_2$" designates a connection between the drive lever 20 and the connecting rod 22.

Furthermore, reference symbol "$L_2$" designates a length of the connecting rod 22, and reference symbol "B" designates an engagement where the connecting rod 22 engages the slide shaft 23. In this case, points "e" and "f" designate positions on the drive shaft 23 and corresponding to points a and b of the arc ab respectively. Reference symbol "$B_1$" designates the engagement B between points e and f. Points "g" and "h" designate positions on the drive shaft 23 and correspond to points c and d of the arc cd respectively. Reference symbol "$B_2$" designates an engagement B between points g and h.

When the control unit controls the output shaft 12*a* of the servomotor 12 so that the connection $A_1$ moves between points a and b of the arc ab, the engagement $B_1$ performs an up-and-down motion while the distance between vibration bottom dead point e and vibration top dead point f serves as amplitude. It is assumed that point e is a vibration start position. It is also assumed that the engagement $B_1$ moves around on an imaginary crank $C_1$ having the center at point i and a crank length $l_1$. Furthermore, the crank $C_1$ has a bottom dead point corresponding to the vibration bottom dead point e and a top dead point corresponding to the vibration top dead point f.

On the other hand, when the control unit controls the output shaft 12*a* of the servomotor 12 so that the connection $A_2$ moves between points c and d of the arc cd, the engagement $B_2$ performs an up-and-down motion while the distance between vibration bottom dead point g and vibration top dead point h serves as amplitude. It is assumed that point g is a vibration start position. It is also assumed that the engagement $B_1$ moves around on an imaginary crank $C_2$ having the center at point j and a crank length $l_2$. Furthermore, the crank $C_2$ has a bottom dead point corresponding to the vibration bottom dead point g and a top dead point corresponding to the vibration top dead point h.

Points e and g on the slide shaft 23 are vibration start positions of the engagements $B_1$ and $B_2$ respectively, that is, vibration start positions of the slide holder 21 and the tapping plate 11 respectively and the level of the tapping plate 11. When the vibration start positions on the slide shaft 23 are moved to respective predetermined positions according to the size of the packaging bag, the level of the tapping plate 11 supported by the slide holder 21 can be adjusted according to the size of the packaging bag, as shown in FIG. 3.

When the engagements $B_1$ and $B_2$ are located at respective vibration start positions, the positions of the connections $A_1$ and $A_2$ are determined via the connecting rod 22, so that the drive lever 20 rotates the output shaft 12*a* by a predetermined angle. In this case, it is assumed that an angle $\theta_0$ made between the drive lever 20 and the auxiliary line $L_0$ is referred to as a rotation start angle. More specifically, when a plurality of rotation start angles is set according to the size of the packaging bags, one of the plural rotation start angles is selected, so that an optimum vibration start position of the tapping plate 11 can quickly be set.

The external storage medium of the control section stores a plurality of optimum vibration start positions of the tapping plates 11 according to the sizes of the packaging bags used with the packaging machine 1 and a plurality of rotation start angles $\theta_0$ corresponding to the optimum vibration start positions, respectively. The data of vibration start positions constitutes one element of the vibration pattern of the tapping plate 11. The data of vibration start angles constitutes one element of the rotation pattern of the output shaft 12*a*. When data relating to the vibration start position contained in the vibration pattern is selected by the selection unit, corresponding data of rotation start angle $\theta_0$ is delivered from the output unit to the control unit.

The control unit controls the output shaft 12*a* so that the output shaft 12*a* is rotated to the rotation start angle $\theta_0$, based on the data relating to the rotation start angle $\theta_0$, which data is contained in the rotation data relating to the rotation pattern and corresponding to the vibration pattern delivered from the output unit. As a result, as illustrated in FIG. 4, the control unit can change the positions of connections $A_1$ and $A_2$ and dispose the tapping plate 11 at the levels of the bottom dead points e and g of imaginary cranks $C_1$ and $C_2$ respectively.

Furthermore, the control unit controls a rotation angle range in which the output shaft 12*a* of the servomotor 12 is rotated. As a result, the drive lever 20 fixed to the output shaft 12*a* and synchronized with the rotation of the output shaft 12*a* can be rotated within a predetermined rotation angle range. In FIG. 4, the rotation angle range relating to the connection $A_1$ is illustrated as the arc ab and the rotation angle range relating to the connection $A_2$ is illustrated as the arc cd. When the connections $A_1$ and $A_2$ are in motion on the arc ab or the arc cd, the drive lever 20 moves the engagements $B_1$ and $B_2$ upward and downward via the connecting rod 22 between the points e and f or the points g and h. More specifically, the output shaft 12*a* is rotated in the predetermined rotation angle range when the tapping plate 11 is desired to be moved with a predetermined amplitude. Accordingly, the external storage medium stores data of a plurality of sizes of packaging bags, types and weights of articles, cubic capacities of packaging bags and the like, optimum amplitudes of the tapping plate 11 according to shapes and weights of packaging bags filled with articles, and data of rotation angle ranges corresponding to the data of respective amplitudes. The amplitude is one of elements constituting data of rotation pattern of the tapping plate 11. The rotation angle range is one of elements constituting data of rotation pattern of the output shaft 12*a*. When data of the size of the packaging bag and data of a predetermined amplitude according to a type of packaging articles are selected by the selection unit, data of rotation angle range corresponding to the amplitude is delivered from the output unit to the control unit.

Based on the data of rotation angle range delivered from the output unit, the control unit controls the output shaft 12*a* so that the output shaft 12*a* is rotated forward and backward within a predetermined rotation angle range defined between one angle and another angle. As a result, as illustrated in FIG. 4, the connections $A_1$ and $A_2$ are rotated forward and backward on the respective arcs ab and cd, so that the engagements $B_1$ and $B_2$ or the tapping plate 11 can be vibrated via the connecting rod 22 with a predetermined amplitude between points e and f or points g and h on the slide shaft 23.

The control unit also controls a rotating speed at which the output shaft 12*a* is rotated. As a result, a rotating speed of the drive lever 20 can be controlled. When the drive lever 20 is rotated at a predetermined rotating speed, the engagements $B_1$ and $B_2$ or the tapping plate 11 is vibrated via the connecting rod 22 at the predetermined rotating speed. This vibration speed can be controlled as a rotating speed at which the imaginary cranks $C_1$ and $C_2$ are rotated. Regarding cranking operations of the imaginary cranks $C_1$ and $C_2$, rotating speeds are variable according to a wavelength and a period contained in the frequency of the tapping plate 11 per unit time. This frequency is one of elements constituting data of vibration patterns of the tapping plate 11, and a plurality of frequencies is stored in the external storage device in the same manner as described above. Furthermore, data of rotating speeds at which the output shaft 12*a* is rotated is also stored in the external storage device so as to correspond to frequency data. When data of a predetermined frequency is selected according to a size of the packaging bag and a type of the articles by the selection unit, data of a corresponding rotating speed is delivered from the output unit to the control unit.

When the output shaft 12*a* is rotated based on the data of rotating speed delivered from the output unit, the drive lever 20 can vibrate the engagements $B_1$ and $B_2$ or the tapping plate 11 via the connecting rod. When the tapping plate 11 is vibrated at a predetermined frequency, the imaginary cranks $C_1$ and $C_2$ are rotated to be in uniform circular motion, for example, so that the frequency of the tapping plate 11 can be represented as sinusoidal waveform. Furthermore, when the imaginary cranks $C_1$ and $C_2$ are rotated reciprocally forward and backward on a semicircle, the frequency of the tapping plate 11 can be represented as saw-tooth or square waveform. Still furthermore, when the crank speed is increased, the tapping plate 11 can be pulsated so that a substantial pulse waveform is obtained.

The external storage medium stores the plural vibration patterns of the tapping plate 11 and the rotation patterns of the output shaft 12*a* corresponding to the respective vibration patterns as described above. Each vibration pattern includes the vibration start position of the tapping plate 11, the amplitude of the tapping plate 11 serving as stroke and the frequency per unit time in the case where the tapping plate 11 is vibrated. The rotation pattern corresponding to the vibration pattern includes the rotation start angle of the output shaft 12*a* corresponding to the vibration start position, the rotation angle range corresponding to the amplitude and the rotating speed corresponding to the frequency. When an optimum one of the plural vibration patterns is selected by the selection unit according to the size of the packaging bag and the type of the articles, the rotation pattern corresponding to this vibration pattern is delivered from the output unit to the control unit. The control unit controls rotation of the output shaft 12*a* based on the data of rotation start angle, rotation angle range and rotating speed of the rotation pattern. As a result, the drive lever 20 is rotated in a predetermined rotation pattern, so that the engagements $B_1$ and $B_2$ or the tapping plate 11 is vibrated up and down via the connecting rod 22 according to the predetermined vibration pattern.

The vibrating device 10 of the embodiment has a simple structure for vibrating the tapping plate 11 by the servomotor 12 and the link mechanism 22. Consequently, the number of manufacturing steps and the number of parts or components can be reduced with the result of reduction in the manufacturing costs. Furthermore, the vibrating device 10 superior in the maintenability can be provided since it has the simple structure.

Furthermore, the level of the tapping plate 11 can easily be changed according to the packaging bag, and the vibration pattern in which the tapping plate 11 is vibrated and the vibration stroke can easily be changed. As a result, an optimum vibration which the vibrating device 10 applies to the packaging bag can flexibly be set according to the size of the packaging bag and the type of the articles. Furthermore, the vibration pattern and vibration stroke are previously set. This can reduce occurrence of variations in the vibration pattern and vibration stroke depending on know-how of the operators. The operator can easily set a vibration pattern and stroke by operating the touch panel to change set values of parameters of the vibration data constituting the vibration pattern.

The foregoing description and drawings are merely illustrative of the present disclosure and are not to be construed in a limiting sense. Various changes and modifications will become apparent to those of ordinary skill in the art. All such changes and modifications are seen to fall within the scope of the appended claims.

What is claimed is:

1. A vibrating device incorporated in a packaging machine which fills packaging bags with articles and vibrating the packaging bags filled with the articles, the vibrating device comprising:

a tapping plate formed into a generally flat shape and disposed below the packaging bags;

a servomotor having an output shaft rotatable forward and backward and located above the tapping plate;

an external storage medium stores a plurality of vibration patterns which includes vibration data inclusive of set parameters including at least one of a vibration start position where the up-and-down motion of the tapping plate is initiated, an amplitude in the case where the tapping plate is vibrated and vibration frequency per unit time in the case where the tapping plate is vibrated, according to data of a packaging bag and an article such as the size of the packaging bag, the type of articles, and an amount of articles filling the packaging bag;

a link mechanism including a drive lever having a proximal end fixed to the output shaft of the servomotor, a slide holder holding the tapping plate, a connecting rod connecting the slide holder and the drive lever to each other, and a slide shaft engaging the slide holder and standing near the tapping plate, fixing the servomotor to an upper part of the slide shaft, connecting the servomotor and the tapping plate to each other and converting rotation of the output shaft into an up-and-down motion of the tapping plate;

a selection unit which selects one of the plurality of vibration patterns set from the external storage medium according to sizes of the packaging bags or types of the articles and relating to the up-and-down motion of the tapping plate;

an output unit which delivers rotation data relating to a rotation pattern of the output shaft, the rotation pattern being set so as to correspond to the selected vibration pattern; and a control unit which controls rotation of the output shaft according to the rotation pattern based on the delivered rotation data, wherein when one of the vibration patterns is selected according to the size of the packaging bag or the type of the articles, the control unit controls rotation of the output shaft according to the rotation pattern corresponding to the vibration pattern, and when the output shaft is rotated, the drive lever rotated with rotation of the output shaft moves the slide holder up and down along the slide shaft via the connecting rod, so that the tapping plate connected via the link mechanism to the output shaft is vibrated up and down in the selected vibration pattern thereby to vibrate the packaging bag.

2. The vibrating device according to claim 1, wherein the servomotor is provided with a reducer.

* * * * *